US005983459A

United States Patent [19]

Goldenberg

[11] Patent Number: 5,983,459

[45] Date of Patent: Nov. 16, 1999

[54] CLIP FOR EYEGLASSES

[76] Inventor: David Goldenberg, 54 W. 87$^{TH}$ St., New York, N.Y. 10024

[21] Appl. No.: 09/097,758

[22] Filed: Jun. 16, 1998

Related U.S. Application Data

[60] Provisional application No. 60/068,573, Dec. 23, 1997.

[51] Int. Cl.$^{6}$ ..... A44B 21/00

[52] U.S. Cl. ..... 24/3.3; 24/326; 24/336

[58] Field of Search ..... 24/3.3, 3.4, 3.9, 24/3.11, 3.12, 3.13, 326, 336; 351/155, 157; 224/250, 269

[56] References Cited

U.S. PATENT DOCUMENTS

| | | | |
|---|---|---|---|
| 3,148,812 | 9/1964 | Hilsinger, Jr. | 24/3.3 X |
| 4,771,515 | 9/1988 | Guarro | 24/3.3 |
| 5,351,098 | 9/1994 | McDaniels et al. | 24/3.3 X |
| 5,408,728 | 4/1995 | Wisniewski | 24/3.3 |
| 5,718,023 | 2/1998 | Billish | 24/3.9 X |

*Primary Examiner*—James R. Brittain
*Attorney, Agent, or Firm*—Collard & Roe, P.C.

[57] ABSTRACT

A clip for securing eyeglasses or sunglasses that slides onto an article of clothing. The clip has two parts integrally formed together and kept in a folded position by a spring. The two parts contact each other near the free ends, similar to a conventional money clip. The outer face of one part of the clip has an elastic material stretched across its width to create a channel for receiving an earpiece of a pair of eyeglasses or sunglasses. The exterior face of the other part of the clip has a forked protrusion, in which the space between forks is approximately equal to the width of an earpiece of a conventional pair of eyeglasses or sunglasses. In use, a piece of clothing is slid between the two parts of the clip. A pair of eyeglasses or sunglasses is mounted on the clip by first sliding one earpiece through the channel formed by the elastic material, and then snapping the other earpiece between the forks of the protrusion on the other side. The clip keeps the glasses securely mounted and prevents them from falling out or moving.

15 Claims, 3 Drawing Sheets

CLIP FOR EYEGLASSES

This patent application is based on U.S. provisional application Ser. No. 60/068,573 filed on Dec. 23, 1997.

BACKGROUND OF THE INVENTION

1. Field of the Invention

This invention relates to a clip for sunglasses or eyeglasses. In particular, the invention relates to a clip that can securely and releasably hold glasses in place on an article of clothing, or order accesible material, such as a back pack strap.

2. The Prior Art

Most people use some type of eyewear, either eyeglasses, sunglasses or both. There are often occasions where the wearer desires to remove the glasses for a temporary period, but keep the glasses in a convenient, easy to reach location.

Many times the wearer tries to hang the glasses on an article of clothing by inserting the earpiece through a pocket or the neck opening of a sweater. However, any sudden or extreme movements causes the glasses to fall out and become lost or broken.

Many different attempts have been made to hold glasses in a convenient location on the body of the user. The oldest and most common type of device is a chain that has loops for holding the earpieces of the glasses. The chain hangs around the wearer's neck and allows the wearer to put on and remove glasses fairly easily. Many variations of this type of holder have been produced, such as neoprene straps that are more suitable for athletic use. This type of device also has many drawbacks. It can be very irritating, especially during athletic activities, to have the eyeglasses or sunglasses swinging about one's neck. In addition, bending over can cause the chain or strap to slide over the wearer's head, causing the glasses to fall off.

SUMMARY OF THE INVENTION

It is therefore an object of the present invention to provide a device for securely and removably affixing glasses to an article of clothing.

It is another object of the present invention to provide a device of the above-mentioned type that is simple and inexpensive to manufacture.

These and other objects of the invention are accomplished by a clip for securing eyeglasses or sunglasses that slides onto an article of clothing. The clip is preferably made from a durable yet flexible polymeric material such as nylon, but metal or other materials could also be used.

The clip has two flat parts integrally formed together and having a spring that keeps the two flat parts folded together. The two parts contact each other near their free ends, similar to a conventional money clip. The outer face of one part of the clip has a flexible strap stretched across its width to create a channel for receiving an earpiece of a pair of eyeglasses or sunglasses. The flexible material is preferably a woven elastic fabric such as neoprene, but any suitable material could be used.

The exterior face of the other part of the clip has a forked protrusion, in which the space between forks is less than the width of an earpiece of a conventional pair of eyeglasses or sunglasses. The protrusion is preferably made of a stiff yet slightly flexible polymeric material, and can be integrally formed with the clip.

In use, a piece of clothing such as the neck band of a sweatshirt or a pocket on a pair of pants is slid between the two parts of the clip. The clip preferably has a textured surface on its inside face to ensure sufficient gripping of the clothing. A pair of eyeglasses or sunglasses is mounted on the clip by first sliding one earpiece through the channel formed by the elastic material, and then snapping the other earpiece between the forks of the protrusion on the other side. The clip is preferably mounted so that the protrusion is on the outside of the clothing and the flexible material faces the wearer's body.

In an alternative embodiment, the front side of the clip has two layers of the elastic material stretched between the lateral sides of the frame. The rear side of the clip is bare. The clip is molded in one piece of slightly flexible material that can be pried open slightly for insertion of a layer of clothing. The front side of the clip can be a solid surface or can be an open frame-like structure. An earpiece retaining device is mounted near the free end of the front side and comprises a rigid bar and a flexible bar mounted to define a small opening for the insertion of the earpiece. The flexible bar flexes to allow for the insertion and removal of the earpiece. Alternatively, the earpiece retaining device can consist of opposing bristles made of rubber or natural fibers.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
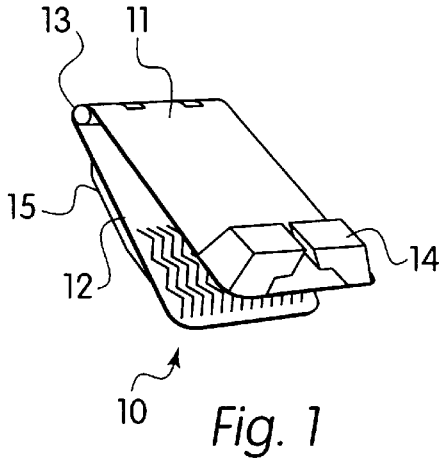
FIG. 1 is a top perspective view of the clip according to the invention.
Figure 2:
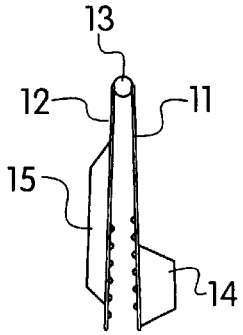
FIG. 2 is a side view of the clip according to the invention.
Figure 3:
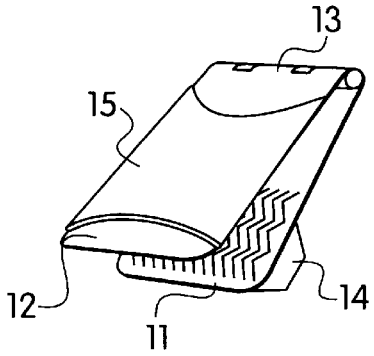
FIG. 3 is a rear perspective view of the clip according to the invention.

Referring now in detail to the drawings and, in particular, FIGS. 1–3, there is shown the clip 10 according to the invention. Clip 10 is comprised of a front part 11 integrally formed with a rear part 12 and bent together by spring 13. Spring 13 keeps front part 11 in tensioned contact with rear part 12, but allows the two parts to be separated by a user's fingers.

The inside surface of front and rear parts 11 and 12 are textured to increase their gripping power on a sweater. A forked protrusion 14 is mounted on front part 11 and allows an earpiece of a pair of eyeglasses to be snapped in. As shown in FIG. 3, an elastic fabric strap 15 is stretched across the lateral sides of rear part 12.

Figure 4:
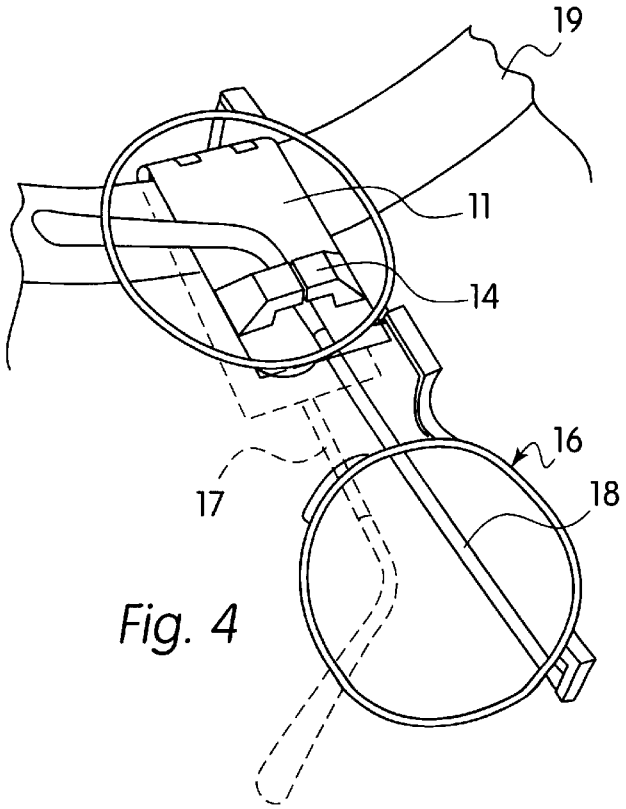
FIG. 4 is a front view of the clip with a pair of glasses mounted thereon.
Figure 5:
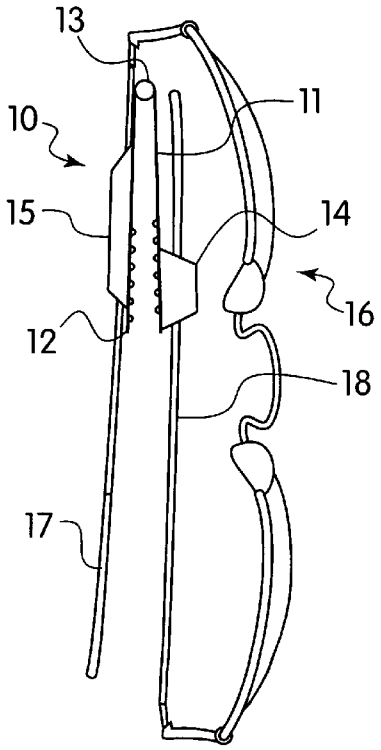
FIG. 5 is a side view of the clip with a pair of glasses mounted thereon.

FIGS. 4 and 5 show the clip in use with a pair of eyeglasses 16 inserted therein. Clip 10 is slid onto the neck band of a sweater 19. Earpiece 17 is then slid between strap 15 and rear part 12. Earpiece 18 is then snapped into forked protrusion 14. Glasses 16 are thus securely held in place and will not become dislodged even with strenuous activity.

Glasses 16 can be easily removed from clip 10 by merely unsnapping earpiece 18 from protrusion 14 and sliding earpiece 17 out from between strap 15 and rear part 12. Clip 10 remains on sweater 19 until the wearer desires to remove it.

Figure 6:
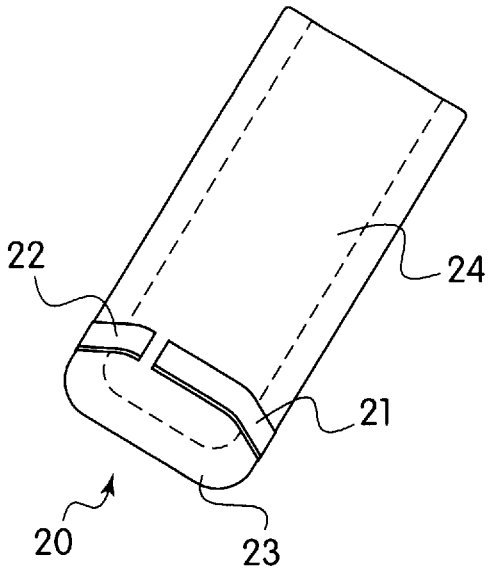
FIG. 6 is a partial front view of an alternative embodiment of the clip according to the invention.
Figure 7:
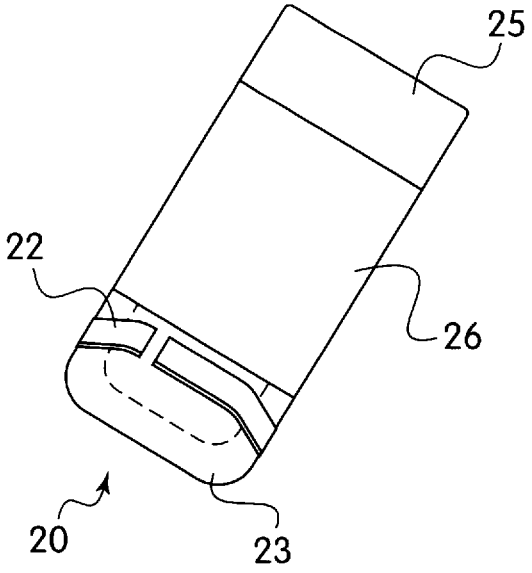
FIG. 7 is a full front view of the embodiment shown in FIG. 6.
Figure 8:
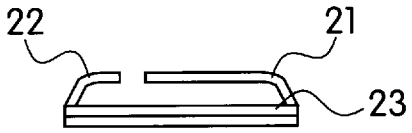
FIG. 8 is a side view along lines VIII—VIII of FIG. 7.
Figure 9:
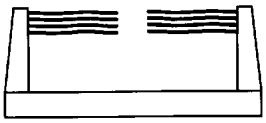
FIG. 9 is a side view of an alternative earpiece retaining device for use in the embodiment shown in FIG. 7.
Figure 10:
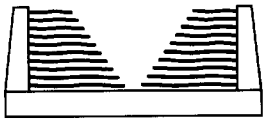
FIG. 10 is a side view of an alternative embodiment of the earpiece retaining device shown in FIG. 9.
Figure 11:
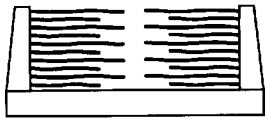
FIG. 11 is a side view of another alternative embodiment of the earpiece retaining device shown in FIG. 9.

An alternative embodiment of the invention is shown in FIGS. 6–8. In this embodiment, an earpiece securing device comprising a rigid bar 21 mounted near the free end of front part 23 and a flexible bar 22 mounted co-linearly with rigid bar 21 on front part 23. There is a small space between bars 21 and 22 to allow an earpiece to snap through. Bar 22 flexes as pressure is applied by an earpiece and allows it to snap through the space between bars 21 and 22.

As shown in FIG. 7, A bottom layer 25 of flexible material is mounted on front part 23 of clip 20. A top layer 26 of flexible material is mounted on top of bottom layer 25. In use, the user slides clip 20 onto an article of clothing and then slides an earpiece of a pair of eyeglasses in between top layer 25 and bottom layer 26. The other earpiece is then snapped into the space between bars 21 and 22 to securely mount a pair of eyeglasses on clip 20. In this embodiment, clip 20 is preferably formed from a single molded piece of plastic that flexes slightly to allow an article of clothing to be slid between front part 23 and rear part 24.

Figure 12:
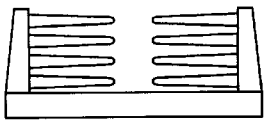
FIG. 12 is a side view of another alternative embodiment of the earpiece retaining device shown in FIG. 9.
Figure 13:
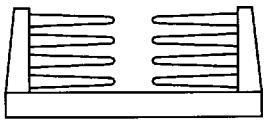
FIG. 13 is a side view of another alternative embodiment of the earpiece retaining device shown in FIG. 9.
Figure 14:
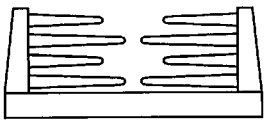
FIG. 14 is a side view of yet another alternative embodiment of the earpiece retaining device shown in FIG. 9.

FIGS. 9–14 show several different embodiments of earpiece retaining devices for use instead of bars 21 and 22. For example, natural fiber bristles 30 could be mounted on supporting elements 31 at the end of front part 12. Bristles 30 keep earpiece 18 in place when it is pushed in between them. Bristles 30 could be arranged in several different configurations, such as a sloping or varied length, shown in FIGS. 10 and 11, respectively. Alternatively, the earpiece retaining device could consist of stiff rubber bristles 35 mounted to supporting elements 31, as shown in FIGS. 12–14. Bristles 35 could also be mounted in a variety of different configurations such as sloping (FIG. 13) or variable lengths (FIG. 14).

The present invention is an improvement over the prior art because it is unobtrusive and securely holds the glasses in place, even under extreme conditions.

Accordingly, while only a few embodiments of the present invention has been shown and described, it is obvious that many changes and modifications may be made thereunto without departing from the spirit and scope of the invention.

What is claimed is:

1. A clip for securing eyeglasses having two earpieces to another surface, comprising:

a flat front part having an inside surface and an outside surface, two side edges a top edge and a bottom edge;

a flat rear part having an inside surface and an outside surface, two side edges, a top edge and a bottom edge;

a tensioned hinge connecting the top edge of said rear part to the top edge of said front part such that said front part overlies said rear part;

a retaining strap attached to the side edges of one of said rear part and front part and extending across the outside surface of one of said rear part and front part; and a securing device mounted to the outside surface of the front part, such that an attaching surface is retained between said front part and rear part by the hinge and the eyeglasses are retained in the clip by sliding one earpiece through the retaining strap and snapping the other earpiece into said securing device.

2. The clip according to claim 1, wherein the hinge is a spring.

3. The clip according to claim 1, wherein the securing device is a forked resilient protruding element having a space for receiving an earpiece, said space being slightly smaller than the width of the earpiece to frictionally retain the earpiece within the protruding element.

4. The clip according to claim 1, wherein the inside surfaces of the front and rear parts are textured to frictionally grip an article of clothing.

5. The clip according to claim 1, wherein the retaining strap is made from an elastic fabric.

6. The clip according to claim 1, wherein the retaining strap extends across the outside surface of the front part.

7. The clip according to claim 6, further comprising a second retaining strap mounted underneath the retaining strap, said retaining straps adapted to securely hold an earpiece therebetween.

8. The clip according to claim 1, wherein the retaining strap extends across the outside surface of the rear part.

9. The clip according to claim 1, wherein the securing device comprises:

a rigid bar connected to one of the side edges of said front part and extending across the outside surface of said front part, said rigid bar having a free end and being raised above the front part; and a flexible bar connected to the other side edge of the front part and extending across the outer surface of the front part co-linearly with said rigid bar, said flexible bar having a free end and being raised above the front part, wherein the free ends of said flexible and rigid bars do not overlap and define an insertion point for an eyepiece, and wherein insertion of the eyepiece causes the flexible bar to bend and allow the eyepiece to be pushed through the insertion point to be retained between said bars and front part.

10. The clip according to claim 1, wherein the front part, rear part and hinge are integrally formed from a single piece of resilient material.

11. The clip according to claim 1, wherein the securing device comprises a supporting element mounted on each side of the front part and a plurality of bristles mounted to each supporting element, the bristles on one supporting element facing the bristles on the other supporting element such that an earpiece is retained between the facing bristles.

12. The clip according to claim 11, wherein the bristles are of varying lengths.

13. The clip according to claim 11, wherein the bristles are made of natural fibers.

14. The clip according to claim 11, wherein the bristles are made of stiff rubber.

15. The clip according to claim 11, wherein the bristles increase in length toward the front part.

* * * * *